United States Patent [19]

Vlach

[11] 4,128,245

[45] Dec. 5, 1978

[54] GOLFER'S TRAINING AID

[76] Inventor: Anthony R. Vlach, 3205 S. 48th St., Omaha, Nebr. 68106

[21] Appl. No.: 532,942

[22] Filed: Dec. 16, 1974

[51] Int. Cl.[2] ..... A63B 69/36

[52] U.S. Cl. ..... 273/183 A; 273/187 R

[58] Field of Search ..... 273/183, 186, 32, 35, 273/208, 33, 187, 202, 203

[56] References Cited

U.S. PATENT DOCUMENTS

| | | | |
|---|---|---|---|
| D. 161,283 | 12/1950 | Rogers | 273/183 A X |
| 1,596,110 | 8/1926 | Lynch | 273/183 A |
| 3,899,179 | 8/1975 | Vlach | 273/183 A |

*Primary Examiner*—George J. Marlo

[57] ABSTRACT

A golf-swing guide comprising a body having flight direction indicator lines and a foot position indicator line thereon, and adapted to be disposed above a golf ball and having a recess on its underside of a suitable size for extending downwardly across a sufficient part of the upper portion of a golf ball for causing the guide body to rest on the top of a golf ball with sufficient stability, the guide also having a tee-receiving opening therethrough.

10 Claims, 11 Drawing Figures

GOLFER'S TRAINING AID

FIELD OF THE INVENTION

This invention is in the field of teaching aids for assisting golfers to improve the accuracy of their golf swing by indicating directions of intended flight and foot stance.

DESCRIPTION OF THE PRIOR ART

The first proposal in the prior art for the positioning of a golf-swing guide on the top of a golf ball was in my own prior patent application Ser. No. 390,076, filed Aug. 20, 1973, titled: GOLF-SWING GUIDE, applicant Anthony R. Vlach now U.S. Pat. No. 3,899,179.

However, I have found that to position the body of a guide above a golf ball with stability under average conditions of wind, requires additional features beyond those found in my earlier patent application.

For example, in my earlier application, there was an opening through the golf-swing guide, but it was only of the small size useful for receiving a tee. Being of such small size, when the guide is used without a tee and above a golf ball, there was no sufficiently great diameter to the edges of the tee-receiving opening for clinging to the top of a golf ball.

The main concept of this invention is to provide a recess on the top of a golf guide body which is of a sufficient diameter so as to receive enough of the uppermost portion of the golf ball so as to give the guide a stability for staying in place balanced on top of the ball under average wind conditions.

Of course, when I say "average wind conditions", it is also possible that even in storm winds, if a ball lies low enough in the ground and grass, the recess size which I propose in this invention for receiving the golf ball would still provide sufficient stability. On the other hand, of course, almost nothing is stable in a sufficient storm.

For these reasons, the recess size range that I propose in this invention is a result of considerable research under actual playing conditions.

The prior art also includes a U.S. Pat. No. 1,596,110, issued on Aug. 17, 1926 to J. H. Lynch, titled: GOLF TEE, but designed to be under a golf ball only, and if it were placed on top of a golf ball in accordance with my concept, it would readily fall off from lack of stability for two reasons, lack of balanced construction, and having a ball bottom-receiving recess which itself is of a different size than I propose and smaller than I propose.

The other patent to be mentioned is the U.S. Pat. No. Des. 161,283, issued to S. J. Rogers on Dec. 19, 1050, and titled: GOLF TEE, and showing a tee for use only under a golf ball and for purposes of being a guide, and having the edges of a recess so remotely spaced from the center of gravity that it would not balance on top of a golf ball with stability in average wind conditions to be found outdoors on a golf course.

However, none of the guide-tees of the prior art have been designed to put on the top of a golf ball.

One of the concepts of my invention is the provision of the stability recess described disposed concentrically with a tee opening completely through the same guide body whereby the guide body can be used alternately as a guide disposed above the ball wherein the tee is not used, such as on fairways, rough, and greens, or it can be used on the tee below the ball for the tee shots.

The prior art, not having the concept of a guide for resting on top of a ball, is further without the concept of making the guide of a thermoplastic cover, soft enough to assist a clinging to the ball, since harder material, such as hard plastic, has a greater tendency to slide off of the golf ball.

A further object is to provide a guide having a body smaller than the diameter of the average golf ball so that it isn't hit by the golf club before the club strikes the ball so as to prevent the guide from being destroyed.

Safety is very important when a guide is to be put on top of a ball. This is because the club head striking the guide can propel it against another careless player's temple and the blow at that or another area might be very serious. For that reason, it is an object of this invention to provide a guide indicator support portion which is circular edged or very blunt, as seen in top plan view, as it quite distinguished from the golf tees of the Rogers and Lynch patents, above-mentioned, both of which have sharp arrow surfaces, dangerous to bystanders. Both also have surfaces which could be destructive to a club head because they are either sharp or, in one case, not sufficiently blunt.

SUMMARY OF THE INVENTION

A golf-swing guide for use at a golf course tee, in the rough, on fairways, and on putting greens, the guide comprising an indicator support, the support being for resting on top of a ball, the guide being for the purpose of assisting a golfer to position himself for his golf-swing to hit the ball in an intended flight direction extending in an intended flight line to one side of the support, a first direction indicator means on the support and visible from the top of the support so as to be substantially alignable with the flight line as seen from above when said support is on top of a golf ball, the support having a ball-top receiving recess means on its underside, the support being balanced sufficiently so that it can rest with substantial stability on top of a golf ball with the top of the ball partially received in the recess means, the recess means having a recess wall, the recess wall having lowermost portions defining at least three points on a circular configuration, the circular configuration having a diameter in a range between one-eighth of an inch and 1⅛ inches, the recess having a sufficient depth upwardly of the circular configuration that all points on the recess wall which are disposed inwardly toward a center of the indicator support are disposed upwardly of a spherical configuration having a diameter of approximately 1.7 inches and a center directly below the center of the circular configuration.

A further object is to provide the golf-swing guide as described in which said indicator support has an upper section and a lower section, the lower section extending downwardly from the upper section, there being an annular recess extending around the upper side of the lower section and disposed between the lower section and the upper section, the upper side of the lower section having an annular wall surface disposed on an opposite side of the annular recess from the upper section, the annular wall surface of the lower section being inclined downwardly from its uppermost portions to its lowermost portions for cooperating with the position of the recess wall of the lower section whereby the thickness of the lower section downwardly of the downwardly inclining upper annular surface thereof at any point is substantially lesser than the thickness of the upper section as measured from bottom to top thereof whereby said lower section can yield slightly at outermost side portions thereof when in engagement with a golf ball and because of the influence of gravity on the indicator support whereby a substantial area of the wall of the ball-receiving recess can be in engagement with the golf ball disposed thereunder.

DESCRIPTION OF THE PREFERRED EMBODIMENT

Figure 6:
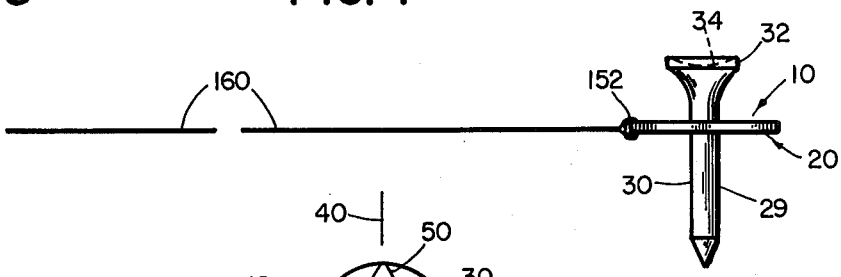
FIG. 6 is a side elevation of the parts shown in FIG. 5.

The golf-swing guide of this invention is generally indicated at 10 in FIG. 6 where it is fully shown and comprises a tee receiver generally indicated at 20 having a vertical tee opening 26 extending completely vertically therethrough for receiving a vertically elongated shank 29 of a standard golf tee generally indicated at 30. The tee 30 has an enlarged upper portion 32 provided with a conventional ball recess shown only in dotted lines at 34.

The shank 29 is cylindrical.

Figure 1:
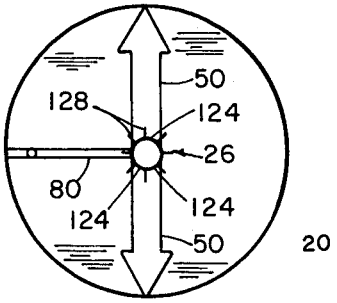
FIG. 1 is a top plan view of one form of the indicator support portion of a golf-swing guide of this invention.
Figure 4:
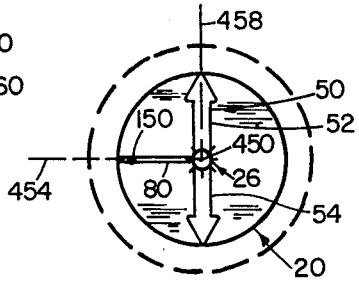
FIG. 4 is a top plan view of the parts shown in FIG. 3 with the golf ball shown in dotted lines and with the foot distance string not being shown, with a full-line indicating the intended flight direction of the ball and with a dotted line indicating the direction of intended foot position.
Figure 5:
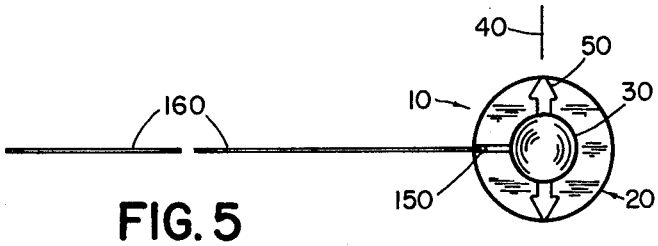
FIG. 5 is a top plan view of the golf-swing guide modification of FIGS. 1 and 3, shown as seen from the top side with a tee shown extending therethrough, the tee being shown in full lines, a foot position string on the guide being shown with a portion of the string broken away.

In accordance with this invention, the tee receiver 20 is provided with a flight direction indicator means generally indicated at 50 disposed on the receiver 20 and visible from the top of the receiver, as best seen in FIGS. 1 and 4 and extending outwardly from the opening 26 and substantially alignable with a straight line 40, best seen in FIG. 5.

Figure 7:
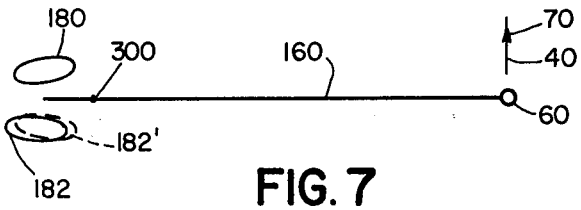
FIG. 7 is a diagram showing the modification of FIG. 3 with the string shown fully and with the position of the feet of a golfer during swinging being shown in full lines and the right foot position of a right-handed golfer being shown in dotted lines in a preliminary position.

The purpose of the tee receiver 20 is to assist a golfer to position himself for his golf swing so as to hit a ball 60 in an intended flight direction as indicated by an arrow 70 in FIG. 7, the intended flight direction 70 extending in a straight line to one side of the opening 26 as the receiver 20 is viewed from above, as seen in FIGS. 5 and 7.

The flight direction indicator means 50 comprises forward and rearward portions 52 and 54 which are substantially aligned with each other and disposed on opposite sides of the opening 26.

The receiver also has thereon, and visible from its upper side, a foot position indicator means 80 extending outwardly from the opening 26 radially at a right angle to the aligned sections 52 and 54 of the intended flight direction indicator means 50.

The respective indicator means 50 with its sections 52 and 54 and the foot position indicator means 80 can all be formed in any manner so as to be visible from the upper side of the receiver 20 and can, for example, be painted on a piece of material of which the receiver 20 is formed.

The receiver 20 can be formed of a disc of plastic or other material circular around its periphery. However, the receiver 20 can also be formed in the manner shown in FIG. 8 in which the numeral 20' is applied to it to indicate that it is modified in the form of a cross having four legs 52', 54', 80' and 100. The legs 52' and 54' are in alignment with each other and elongated, and in the modified receiver 20' of FIG. 8, can be considered respectively to be the two sections of the intended flight direction indicator means which, in the FIG. 8 modification, is given the numeral 50'. The leg 80', therefore, serves as a foot position indicator means because of its length and straightness. All of the legs 52', 54', 80' and 100 of the modification of FIG. 8 extend radially outwardly from a vertical tee opening 26' therethrough, which is of an identical description to the vertical tee opening 26 of the modification of FIG. 4, which will now be further described.

Referring to FIG. 4, it will be seen that the tee receiver 20 is formed of a material which is sufficiently yielding and resilient and so shaped in portions thereof disposed adjacent the tee opening 26 that the receiver 20 will cling to the shank 29 of a standard tee 30 without allowing the receiver to fall downwardly on the shank 29, and yet so that the receiver can be manually rotated on the shank 29 for alignment of its intended flight direction indicator means 50 with the straight line 40 representing the intended flight direction.

Specifically, this is preferably accomplished by providing the opening 26 with a shape such that the majority of its wall surface is formed of segments 124 of a circle separated from each other by radial slits 128 extending radially outward from the center of the opening 26 so as to provide the opening 26 with the total shape adapted to yield and cling in the manner described.

The material of which the receiver 20 is formed is of a resilient nature.

As best seen in FIG. 5, the receiver 20 has a hole 150 therethrough disposed radially outward from the center of the opening 26 in a direction along the foot indicator means 80. The hole 150 is for the purpose of attachment of a knot 152 of a string 160, which latter is of a length suitable for extending from the center of the receiver 20 horizontally outward to a point adjacent the feet 180 and 182 diagrammatically shown in FIG. 7 of the golfer who is standing in a position and ready to swing at the ball 60. The length of the string 160 can be said to be sufficiently long for whatever golfer is using the golf-swing guide 10, whether child, adult, of any size.

Figure 2:
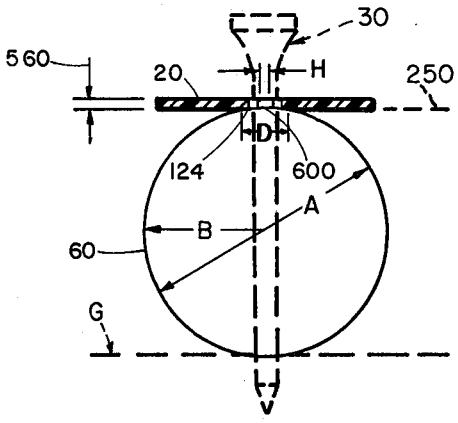
FIG. 2 is a sectional view of the indicator support modification of FIG. 1 taken diametrically across the center thereof in any direction and shown with a golf ball diagrammatically outlined therebeneath in full lines and with a tee shown extending therethrough in dotted lines, a dotted line indicating ground position, when the guide indicator support is disposed on a golf ball. An upper dotted line indicates ground position under the indicator support when the support is used on a tee rather than above a ball.

Referring to FIG. 2, the ground is shown at 250 with a tee 30 inserted into it with most of its shank 29 being shown in dotted lines because it is under the ground and showing that the receiver 20 can be used in the position on the shank so as to define by its underside a position of maximum intended depth of insertion into the ground of the tee 30 so that if a receiver 20 is placed on a tee in a desired position before going to the golf course, then at the time of positioning the tee it can be inserted into the ground to the depth required to place the underside of the receiver 20 on the ground.

In operation, the receiver 20 is then rotated about the shank 29 until its intended flight direction indicator means 50 is in alignment with the line 40 of intended flight direction. Thereafter, the string 160 is stretched out in alignment with the foot position indicator means 80 with some care to avoid the rotation of the receiver 20 on the tee during this process, assisted by the fact that the receiver exerts a considerable pressure on the tee to prevent the dislocation accidentally of the receiver 20 with respect to a tee that is already in the ground.

The string 160 can be provided with a knot 300, best seen in FIG. 7, placed by the golfer on the string in a position indicating the preferred position in which the toe of the golfer's foot 180 is to be positioned with respect to the ball 60. The knot can be placed at whatever selected distance has been found to be effective for a particular golfer.

Next, the golfer moves his right foot, assuming he is a right-handed golfer, from a dotted line position 182' to the full-line position 182, shown in FIG. 7.

The golfer then makes his golf-swing, being aided in his sighting for a good swing by the intended flight direction indicator means 50 and by the string 160.

The total size of the receiver 20 can vary considerably from a size so small that its indicator means 50 cannot be seen after the ball is placed on it to a size larger than that, even up to 6 inches, although a size that will fit in the golfer's pocket conveniently is important.

The minimum size for the receiver 20 would perhaps be only slightly larger than the opening 26 itself, since if the receiver 20 is little more than the size of a dime the lines on it would serve less well, but would still be useful provided they are viewed before the ball is put on the tee, since the ball would obscure so small a receiver 20.

It is important that the receiver 20 be comfortable to carry in the golfer's pants pocket. In accordance with that concept, the receiver can be circular on its periphery or else can be made in a shape of a cross shown in FIG. 8, but with the outer ends of the legs 52', 54', 80' and 100 blunted and rounded so as not to be dangerous from the standpoint of puncturing one's leg in the event that during bending over, or something accidentally striking the receiver in a person's pocket, the end of the leg might press into the thigh of the golfer.

Figure 3:
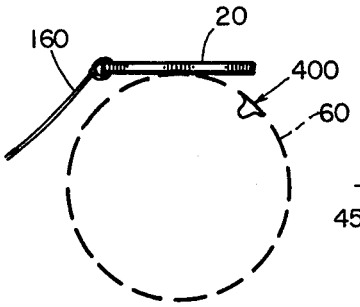
FIG. 3 is a side elevation of the golf-swing guide modification of FIG. 3, but with a cord attached thereto for indicating foot position distance from a ball, the major portion of the cord being broken away, and a golf ball shown beneath and supporting the indicator support being shown partially in full lines and partially in dotted lines.
Figure 8:
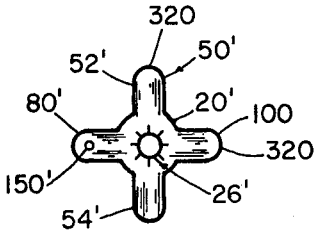
FIG. 8 is a top plan view of a modification of the indicator support of a golf-swing guide.

The fourth leg 100 of the modified receiver 20' of FIG. 8 is simply for the purpose of balancing the receiver so as to balance the leg 80' so that the receiver can rest on the top of a golf ball in the manner shown in FIG. 3 without tending to fall off, the string 160 being so light as not to disturb the balance enough to prevent use in the manner shown in FIG. 3, as is important on fairways and greens where tees are not used and the resting of the receiver directly on top of a ball makes possible a sighting even though the receiver is removed before swinging after the golfer has positioned his feet properly.

Figure 9:
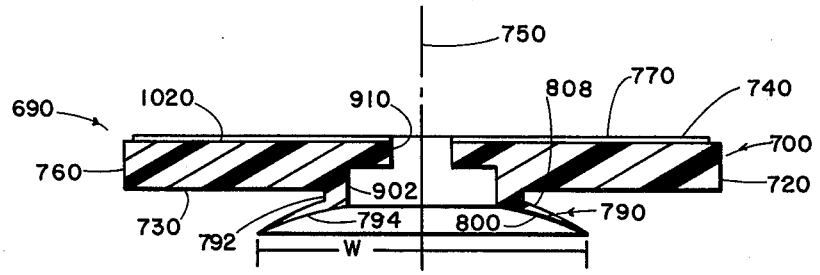
FIG. 9 is a cross-sectional view taken in a vertical plane through the center of a symmetrical indicator support of a third modification of the golf-swing guide of FIG. 1, a vertical axis therethrough being shown in dotted lines.

In FIG. 9 a modified golf-swing guide generally indicated at 700 is shown having an upper disc portion 720 having a planar undersurface 730 and having an upper surface which is basically planar as seen at 740, except that it has indicator arrows extending upwardly therefrom, as will now be described.

A first direction indicator means is provided on the indicator support 700 and is seen at 770 and can be caused to face in a direction such that an arrow head 772 on its outer end can have its point 774 pointed in the direction of the intended flight of a golf ball to be hit. In general, the first direction indicator means 770 is substantially in alignment with the flight line of a golf ball to be hit, as seen from looking downwardly on the indicator support 700 from the top. The reason it is possible to talk in terms of "substantial alignment" is because the intended flight direction first indicator means 770 is generally straight and has two straight parallel sides 776 on each side of a radius line extending outwardly from a center axis 750 of the cylindrical vertical outer surface 760 of the upper portion 720 on which the indicator means 770 is mounted.

The indicator support 700 further has a lower portion generally indicated at 790, which latter has a upper section 792 which is of cylindrical shape on its outer side and on its inner side, the upper section 792 having attached to its annular lower end a lower section 794 which is similar to a vacuum cup and which has an annular concave undersurface 800, the undersurface 800 being on a radius, for example, of approximately 1¾ inches from the center disposed downwardly along the axis 750 and not shown. The upper surface 808 of the lower section 794 is also annular and also connected to the outside of the upper section 792, and is also disposed on the arc of a sphere, as is the case with the concave undersurface 800, but the sphere on which the upper surface 808 is disposed has a greater radius from the center downwardly therefrom along the axis 750, the latter radius being, for example, approximately 1 1/16 inches or other suitable dimension, whereby the lower section tends to taper from a thicker inner annular portion to a very thin outer annular edge so that when the indicator support is rested on a golf ball, the outermost annular section of the lower portion which is adjacent its terminal circular edge is adapted to yield upwardly very, very slightly in order to assure a good contact with the ball since it will assume exactly the shape of the ball exterior and give a maximum area of assured fit and engagement to provide friction to prevent the guide from blowing off of the ball under wind conditions normally experienced on a golf course.

Figure 2A:
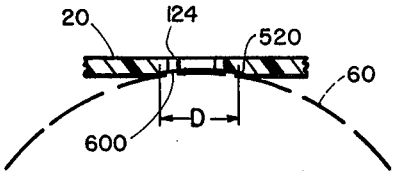
FIG. 2A is a view similar to FIG. 2, but showing the indicator support in double scale, edge portions of the support being broken away and a dotted line indicating the position of the upper surface portion of a golf ball.

The annular wall of the recess 600 of FIGS. 2 and 2A has a maximum diameter at its lower end of preferably approximately three-fourths of an inch, as is the same maximum diameter of the lowermost parts of the undersurface 800 of the lower section 794 of the indicator support modification 700 of FIG. 9, as measured at W.

The upper surface of the majority of the upper side of the upper portion 720 of the modification of FIG. 9 is flat and planar and horizontal as seen at 1020 and is parallel to the undersurface 730 of the upper portion 720.

The modified indicator support 700 of FIG. 9 has a tee opening 910 for receiving a tee vertically downwardly therethrough and the tee will be gripped firmly because the opening 910 is circular and of a diameter for gripping a tee that is approximately one-eighth of an inch in diameter. It is preferred that there be a counter recess 902 which is of greater depth than the annular concave undersurface 800 as measured upwardly from the lowermost horizontal parts of the indicator support modification 700. This construction permits the upper portion 720 to be of a vertical thickness between its surfaces 730 and 1020 of one-eighth of an inch, more or less, whereas the most constricted portion of the tee opening 910 is its uppermost portion and it is of only half that depth, for example, one-sixteenth of an inch, as is better suited to easy yielding to permit a tee to be inserted freely therethrough, but with sufficient clinging to the tee to hold the indicator support in place thereon with the tee is used.

The first flight indicator means 770 further has a rearward portion 1020 with an arrow 1022, which latter is substantially aligned with the portion on the opposite side of the tee opening 910 and it will be seen that a left-handed golfer would stand with his feet outwardly from a foot position indicator means 1040 with an arrow 1042, which latter extends in a direction outwardly from the opening 910 which is at a right angle to the other two arrows 772 and 1022. A right-handed golfer, with his feet disposed in a direction away from the guide in the direction of the arrow 1042, would be using the arrow 1022 to indicate flight direction and the arrow 774 to indicate a direction opposite flight direction.

Figure 10:
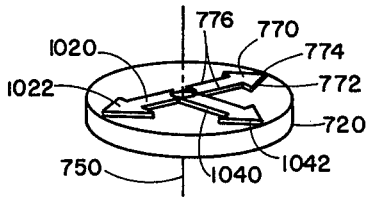
FIG. 10 is a perspective view of the third modification of the indicator support shown in FIG. 9 as it would be seen from the top and to one side at an angle such that the lower portion of thereof is not visible, a vertical axis line therethrough being shown in dotted lines.

All of the flight direction indicators, including arrows 774, 1022, and 1042, are formed of the same integral one piece of material with all of the rest of the portions of the indicator support 700 shown in FIGS. 9 and 10, and are formed by having them upraised from the surface 1020 a slight distance. They can also be colored on their upper sides a different color than the remainder of the indicator support, which latter can be white, while the upper surface of the arrows can be, for example, red.

It is desirable that the entire golf-swing guide indicator support, whether it be the modification of FIG. 2 as shown at 20, or the modification of FIGS. 9 and 10 as shown at 700, be made of thermoplastic rubber substance such as polyvinyl chloride or equivalent and preferably of hardness of 1600 series such as to cling to a golf ball, and in any case, of a hardness preferably less than 2800 series which would damage a club head.

It is possible that the lower section 794 of the indicator support 700 be made of a different piece of material from the upper section 720, but in any case, must be secured together strongly enough that they will not separate when the guide is struck repeatedly with a golf ball.

In general, the greater the thickness of the upper section 720 of the indicator support 700, the lesser the area of the undersurface 800 of the ball recess needs be in order to gain equal stability. It is desirable, however, that the guide be substantially of the shape and size shown in FIG. 9, keeping it in mind that this view is drawn on double scale.

Anything said as regards the shape of the recess 800 of FIG. 9 as regards dimensions applies also to the shape of the dimensions of the recess 600 of FIGS. 2 and 2A.

The actual official diameter of the official golf ball is 1.6910173 inches. It is important that the depth of a ball-receiving recess be sufficient so that its lower edge is not prevented from good engagement with the ball, and apart from anything else said herein, that is of great importance.

While the thermoplastic rubber of the 1600 series is preferred, yet anything stiffer than a 2800 series would damage a club, in my opinion. Referring to the dimensiond in FIG. 2A and the dimension W in FIG. 9, both of these dimensions indicate the diameter of the lowermost portions of the wall fo the ball-receiving recess 600 in FIGS. 2 and 2A and 800 of FIG. 9, and these diameters are both in a range between one-eighth of an inch and 1⅛ inches, even though the dimension of approximately three-fourths of an inch is preferred.

I claim:

1. A golf-swing guide for use at a golf course tee, in the rough, on fairways, and on putting greens, said guide comprising an indicator support, said support being for resting on top of a ball, said guide being for the purpose of assisting a golfer to position himself for his golf-swing to hit said ball in an intended flight direction extending in an intended flight line to one side of said support, a first direction indicator means on said support and visible from the top of said support so as to be substantially alignable with said flight line as seen from above when said support is on top of a golf ball, said support having a ball-top receiving recess means on its underside, said support being balanced sufficiently so that it can rest with substantial stability on top of a golf ball with a top of said ball partially received in said recess means, said recess means having a recess wall, said recess wall having lowermost portions defining at least three points on a horizontal circular configuration, said circular configuration having a vertical axis through its center, said circular configuration having a diameter in a range between one-eighth of an inch and 1⅛ inches, said recess means having a sufficient depth upwardly of said circular configuration that all points on said recess wall which are disposed inwardly toward said axis are disposed upwardly of a certain spherical configuration, said certain spherical configuration having a diameter of approximately 1.7 inches and a center on said axis and disposed directly below the center of said circular configuration.

2. The golf-swing guide as described in claim 1 in which said indicator support has an upper section and a lower section connected to said upper section, said lower section extending downwardly from said upper section, there being an annular notch extending around the upper side of said lower section and disposed between said lower section and said upper section, said lower section having an upper side defined by an annular upper wall surface disposed on an opposite side of said annular notch from said upper section, said annular upper wall surface of said lower section being inclined downwardly from its uppermost portions to its lowermost portions for cooperating with the position of said recess wall whereby the vertical thickness of said lower section under said downwardly inclining upper annular surface thereof at any point is substantially lesser than the average whereby portions of said lower section farthest from said axis can yield upwardly slightly at outermost side portions thereof when in engagement with said golf ball because of the influence of gravity on said indicator support whereby a substantial area of the wall of said ball-receiving recess can be in engagement with the golf ball disposed thereunder for good frictional contact therewith.

3. The golf-swing guide of claim 1 in which said support has a vertical tee opening extending completely therethrough, said recess means defining at least a portion of said tee opening, said recess means being larger as seen from the underside of said indicator support then the smallest part of said tee opening.

4. The golf-swinging guide of claim 3 in which the exterior of the guide as seen in top plan view is free of substantially pointed portions for lesser damage to persons who might be struck by it.

5. The golf-swing guide of claim 1 in which said flight direction indicator means comprises forward and rearward portions substantially aligned with each other and on opposite sides of a center of said support.

6. The golf-swing guide of claim 1 further comprising foot position indicator means on said support and visible from the top thereof and indicating a position on a straight foot position line extending at a right angle to said first direction indicator means.

7. The golf-swing guide of claim 1 in which said first direction indicator means comprises straight line means disposed substantially parallel to a vertical plane extending from said axis when said support is placed so that said first direction indicator means points substantially horizontally.

8. The golf-swing guide of claim 1 in which said circular configuration has a diameter of approximately three-fourths of an inch.

9. The golf-swing guide of claim 1 in which said indicator support is formed of a thermoplastic rubber substance.

10. The golf-swing guide of claim 1 in further combination with a golf ball, and in which the golf-swing guide is balanced on top of the golf ball with the said ball-receiving recess extending over a portion of the upper side of the golf ball.

* * * * *